US007703896B2

(12) United States Patent
Takahashi

(10) Patent No.: US 7,703,896 B2
(45) Date of Patent: Apr. 27, 2010

(54) LIQUID-DROPLET JETTING APPARATUS AND LIQUID TRANSPORTING APPARATUS

(75) Inventor: Yoshikazu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 777 days.

(21) Appl. No.: 11/493,627

(22) Filed: Jul. 27, 2006

(65) Prior Publication Data

US 2007/0024678 A1 Feb. 1, 2007

(30) Foreign Application Priority Data

Jul. 27, 2005 (JP) ..... 2005-216707

(51) Int. Cl.
*B41J 2/045* (2006.01)

(52) U.S. Cl. ..... 347/68; 347/70

(58) Field of Classification Search ..... 347/68–72
See application file for complete search history.

(56) References Cited

U.S. PATENT DOCUMENTS 5,344,117 A * 9/1994 Trah et al. ..... 251/11
6,039,440 A * 3/2000 Osawa et al. ..... 347/70
6,971,738 B2 12/2005 Sugahara
7,380,916 B2 * 6/2008 Sugahara ..... 347/68
2003/0210306 A1 11/2003 Takahashi et al.
2005/0068376 A1 3/2005 Sugahara

FOREIGN PATENT DOCUMENTS

JP H11 309864 11/1999
JP 2003 326704 11/2003
JP 2004 166463 6/2004
JP 2005 125743 5/2005

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

An ink-jet head includes a channel unit having pressure chambers; and a piezoelectric actuator which includes a vibration plate having an electroconductive substrate and an insulating layer, a piezoelectric layer arranged in an area overlapping with the pressure chamber, and a common electrode and an individual electrode formed on the piezoelectric layer. A recess is formed in an area overlapping with the pressure chamber. A wiring connected to the individual electrode is formed on the upper surface of the vibration plate in an area in which the piezoelectric layer is not formed. Accordingly, there is provided a liquid-droplet jetting apparatus and a liquid transporting apparatus having an improved durability, requiring a less electric power consumption, capable of performing a pulling ejection, and in which a wiring can be performed highly densely.

18 Claims, 13 Drawing Sheets

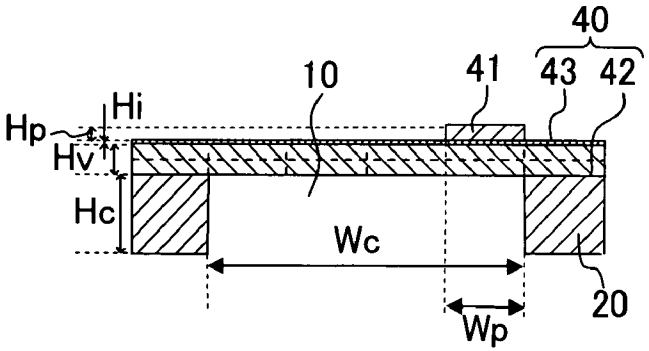
Fig. 10A
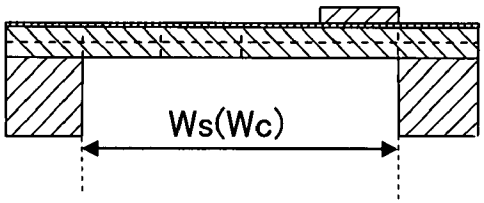
Fig. 10B
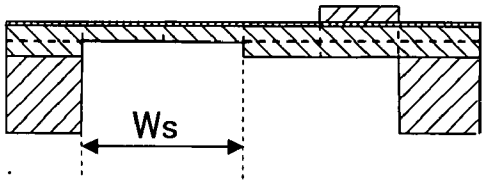
Fig. 10C
Fig. 10D
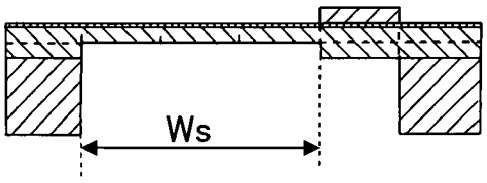
Fig. 10E
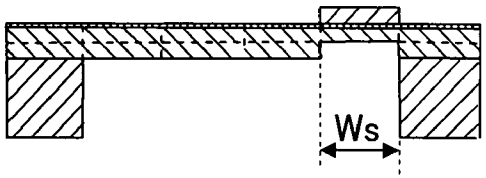
Fig. 10F
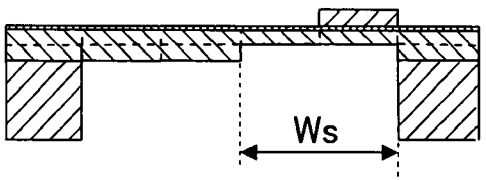
Fig. 10G
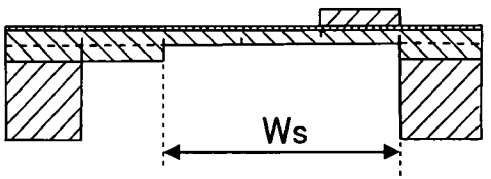
Fig. 10H

LIQUID-DROPLET JETTING APPARATUS AND LIQUID TRANSPORTING APPARATUS

CROSS REFERENCE TO RELATED APPLICATION

The present application claims priority from Japanese Patent Application No. 2005-216707, filed on Jul. 27, 2005, the disclosure of which is incorporated herein by reference in its entirety.

BACKGROUND OF THE INVENTION

1. Field of the Invention

The present invention relates to a liquid-droplet jetting apparatus which jets liquid droplets, and a liquid transporting apparatus which transports a liquid.

2. Description of the Related Art

Among ink-jet heads (liquid-droplet jetting apparatuses) which perform recording on a recording medium by applying pressure to an ink in a pressure chamber communicating with a nozzle to discharge the ink from the nozzle, there is an ink-jet head in which a vibration plate arranged to cover a pressure chamber is deformed by a piezoelectric actuator so as to apply pressure to an ink in the pressure chamber. For example, in an ink-jet head described in FIG. 3 of U.S. Patent Application Publication No. US 2005/0068376 A1 (corresponding to FIG. 3 of Japanese Patent Application Laid-open No. 2005-125743), a piezoelectric layer is formed on an upper surface of a vibration plate, and an upper electrode (individual electrode) is formed on a portion of an upper surface of the piezoelectric layer, the portion overlapping with a pressure chamber. Further, the ink-jet head performs a so-called pushing ejection in which electric potential of the upper electrode is made to be higher than electric potential of the vibration plate as a lower electrode so as to deform the vibration plate to project toward the pressure chamber, thereby applying pressure to an ink in the pressure chamber so that the ink is discharged from a nozzle.

In the ink-jet head described in FIG. 3 of U.S. Patent Application Publication No. US 2005/0068376 A1 (corresponding to FIG. 3 of Japanese Patent Application Laid-open No. 2005-125743), in addition to the pushing ejection described above, it is also possible to perform a so-called pulling ejection. In other words, by making the electric potential of the upper electrode to be higher than the electric potential of the vibration plate in advance, thereby deforming the vibration plate to project toward the pressure chamber, and every time when there is a demand for ink discharge, the vibration plate is first made to return to its original shape (recover from the deformation), and then the vibration plate is deformed once again at a predetermined timing, thereby making it possible to discharge the ink from the nozzle. In such a pulling ejection, by deforming the vibration plate once again to project toward the pressure chamber at a timing when a negative pressure wave, generated when the deformed vibration plate is returned to its original shape, turns to positive pressure wave, it is possible to superpose this pressure wave and the positive pressure wave, thereby making it possible to apply, to the ink in the pressure chamber, a pressure greater than a pressure in a case of the pushing ejection. Therefore, by performing the pulling ejection, it is possible to drive the ink-jet head at a low voltage than by performing the pushing ejection.

For performing a pulling ejection in the ink-jet head described in FIG. 3 of U.S. Patent Application Publication No. US 2005/0068376 A1, however, it is necessary to maintain the upper electrode at an electric potential higher than an electric potential of the vibration plate all the time when ink is not discharged, and to continue to apply an electric field in the piezoelectric layer. Therefore, there is a fear that the durability of a piezoelectric layer is declined. Further, electric power consumption is also increased.

On the other hand, an ink-jet head, described in U.S. Pat. No. 6,971,738 (corresponding to Japanese Patent Application Laid-open No. 2004-166463), includes a channel unit in which a plurality of pressure chambers is formed, and a piezoelectric actuator having a plurality of piezoelectric sheets and individual electrodes (drive electrodes) and common electrodes arranged alternately between these piezoelectric sheets. The individual electrodes and the common electrodes are formed to overlap with one of the pressure chambers and to have a ring shape (annular shape) along an edge of the pressure chamber as viewed form a direction orthogonal to plane of the piezoelectric sheet.

Further, in this piezoelectric actuator, when a drive voltage is applied to the individual electrodes with the common electrodes kept at a ground electric potential, the piezoelectric sheets are deformed to project toward a side opposite to the pressure chamber. Therefore, it is possible to perform the pulling ejection as described above. Furthermore, in this case, it is enough that the drive voltage is applied to the individual electrodes only at timing when the ink is discharged. Consequently, the electric field is not applied to the piezoelectric sheets except for the timing of ink discharge, and thus polarization is hardly degraded in the piezoelectric sheets. Therefore, there is an advantage that durability of the actuator is enhanced.

However, in this piezoelectric actuator, due to a problem of a cross talk and/or the like, a wiring connecting each of the individual electrodes and a driver IC is formed in an area, on a surface of the uppermost piezoelectric sheet, which does not overlap with any of the individual electrodes. Here, each of the individual electrodes has a size such that the individual electrode substantially overlaps in a plan view with one of the pressure chambers. Accordingly, the area on the surface of the uppermost piezoelectric sheet, in which the wiring may be formed, is substantially limited to an area which does not overlap with any of the pressure chambers. Therefore, when the pressure chambers are to be arranged highly densely, drawing of the wiring connecting each of the individual electrodes and the driver IC becomes very difficult. Particularly, when the pressure chambers are to be arranged in a large number of rows, for example, in not less than three rows, the drawing of the wiring from an individual electrode corresponding to a pressure chamber arranged in an inner row among the rows becomes problematic. In such a situation, so far, a method of using a wiring member such as an FPC was adopted in many cases. However, this method lacks reliability of mechanical connection because the strength of connections is very weak.

SUMMARY OF THE INVENTION

An object of the present invention is to provide a liquid-droplet jetting apparatus and a liquid transporting apparatus having a high durability and less power consumption, in which a wiring corresponding to the pressure chambers arranged highly densely can be realized.

According to a first aspect of the present invention, there is provided a liquid-droplet jetting apparatus which jets liquid droplets, the apparatus including:

a channel unit which includes a pressure chamber communicating with a nozzle; and a piezoelectric actuator which changes a volume of the pressure chamber to apply a pressure to a liquid in the pressure chamber, and which includes a plate arranged on one surface of the channel unit so as to cover the pressure chamber; a piezoelectric layer arranged at an area overlapping with the pressure chamber such that the piezoelectric layer is extended in a predetermined direction from one edge of the pressure chamber in the predetermined direction, the area being on a surface of the plate on a side opposite to the pressure chamber; an individual electrode arranged on one surface of the piezoelectric layer; and a common electrode arranged on the other surface of the piezoelectric layer;

wherein a length in the predetermined direction of a portion, of the piezoelectric layer, which faces the pressure chamber is smaller than half a length of the pressure chamber in the predetermined direction.

According to the first aspect of the present invention, when an electric potential difference is generated between the individual electrode and the common electrode so as to generate an electric field in a portion of the piezoelectric layer sandwiched between the individual electrode and the common electrode, an end (edge) of a portion, of the plate (such as a vibration plate), at which the piezoelectric layer is arranged, is deformed to warp or curve upward, and the volume of the pressure chamber is increased. Consequently, by generating the electric potential difference between the individual electrode and the common electrode so as to increase the volume of the pressure chamber, and then by making the volume of the pressure chamber to return to the original volume by eliminating the electric potential difference between the individual electrode and the common electrode, the pressure can be applied to the liquid in the pressure chamber, thereby jetting the liquid droplets from the nozzle. Accordingly, in a case of performing the pulling ejection in which the liquid is jetted from the nozzle by making the volume of the pressure chamber return to the original volume after once increasing the volume of the pressure chamber, it is not necessary to generate in advance the electric potential difference between the individual electrode and the common electrode when the liquid droplets are not being jetted. Accordingly, it is possible to improve the durability of the piezoelectric layer and to reduce the electric power consumption. However, if the length of the piezoelectric layer in the predetermined direction is excessively long, an intermediate portion of the portion, of the vibration plate, in which the piezoelectric layer is arranged is dented toward the pressure chamber, and the volume of the pressure chamber is decreased. Therefore, it is desirable that the length of the piezoelectric layer in the predetermined direction is smaller than half the length of the pressure chamber in the predetermined direction.

In the liquid-droplet jetting apparatus of the present invention, the pressure chamber may have a shape symmetrical with respect to a straight line passing through a center of gravity of the pressure chamber and orthogonal to the predetermined direction. In this case, since the pressure chamber is symmetrical with respect to the straight line passing through the center of gravity of the pressure chamber, the piezoelectric layer can be arranged on any side of this straight line, and a degree of freedom of arranging the piezoelectric layer becomes higher.

In the liquid-droplet jetting apparatus of the present invention, the pressure chamber may have an elongated shape, and the predetermined direction may be a transverse direction of the pressure chamber. In this case, it is possible to arrange the pressure chambers highly densely.

According to a second aspect of the present invention, there is provided a liquid-droplet jetting apparatus which jets liquid droplets, the apparatus including:

a channel unit which includes a pressure chamber communicating with a nozzle; and a piezoelectric actuator which changes a volume of the pressure chamber to apply a pressure to a liquid in the pressure chamber, and which includes a plate arranged on one surface of the channel unit so as to cover the pressure chamber and having a surface with insulating property, the surface being on a side opposite to the pressure chamber; a piezoelectric layer arranged, at an area overlapping with the pressure chamber such that the piezoelectric layer is extended in a predetermined direction from one edge of the pressure chamber in the predetermined direction, the area being on the surface of the plate on the side opposite to the pressure chamber; an individual electrode arranged on one surface of the piezoelectric layer; and a common electrode arranged on the other surface of the piezoelectric layer;

wherein a length in the predetermined direction of a portion, of the piezoelectric layer, which faces the pressure chamber is smaller than half a length of the pressure chamber in the predetermined direction; and a wiring connected to the individual electrode is formed in an area in which the piezoelectric layer is absent, the area being on the surface of the plate on the side opposite to the pressure chamber.

According to the second aspect of the present invention, there is a portion in the area, of the plate such as a vibration plate, overlapping with the pressure chamber, the portion not being formed with the piezoelectric layer. Furthermore, since the surface of the plate (vibration plate) on the side opposite to the pressure chamber has insulating property, it is possible to form a wiring also in the portion in which the piezoelectric layer is absent. Consequently, the degree of freedom of arranging the wiring, for applying the voltage to the individual electrode, on the surface of the plate on the side opposite to the pressure chamber becomes higher. In other words, when there is a large number of individual electrodes (or pressure chambers), the wirings can be arranged highly densely. Further, by forming the wiring in the portion in which the piezoelectric layer is not formed, it is possible to prevent the generation of an excessive electrostatic capacitance due to the wiring, and to decrease a loss of energy. Furthermore, since an external wiring such as the FPC is not used, it is possible to enhance a mechanical strength of wire connections.

In the liquid-droplet jetting apparatus of the present invention, the pressure chamber may have a shape symmetrical with respect to a straight line passing through a center of gravity of the pressure chamber and orthogonal to the predetermined direction. Alternatively, in the liquid-droplet jetting apparatus of the present invention, the pressure chamber may have an elongated shape, and the predetermined direction may be a transverse direction of the pressure chamber.

In the liquid-droplet jetting apparatus of the present invention, the plate may have an electroconductive substrate which is plate-shaped and is arranged on the one surface of the channel unit, and an insulating layer formed on a surface of the electroconductive substrate on a side opposite to the pressure chamber. Accordingly, by forming the insulating layer on the surface of the electroconductive substrate made of a metallic material, it is possible to easily form a plate having an electroconductive property on the surface on the side opposite to the pressure chamber.

Further, in the liquid-droplet jetting apparatus of the present invention, the plate may be formed of an insulating material. Accordingly, it is possible to easily form a plate having an insulating surface.

In the liquid-droplet jetting apparatus of the present invention, the length in the predetermined direction of the portion, of the piezoelectric layer, which faces the pressure chamber may be in a range of 1/12 to 1/3 of the length of the pressure chamber in the predetermined direction. Accordingly, when the electric potential difference is generated between the individual electrode and the common electrode, it is possible to assuredly increase the volume of the pressure chamber.

Further, in the liquid-droplet jetting apparatus of the present invention, the length in the predetermined direction of the portion, of the piezoelectric layer, which faces the pressure chamber may be 1/4 of the length of the pressure chamber in the predetermined direction. Accordingly, when the electric potential difference is generated between the individual electrode and the common electrode, it is possible to substantially increase the volume of the pressure chamber particularly.

Further, in the liquid-droplet jetting apparatus of the present invention, a thinned portion may be formed in a portion of the plate facing the pressure chamber, the thinned portion having a thickness smaller than a thickness of other portion of the plate; and the thinned portion may have an area not overlapping with the piezoelectric layer. Accordingly, since the vibration plate is easily deformed in particular at the portion formed with the thinned portion, when the electric potential difference is generated between the individual electrode and the common electrode, the volume of the pressure chamber is increased substantially.

In the liquid-droplet jetting apparatus of the present invention, the thinned portion may be extended in the predetermined direction from the other edge in the predetermined direction of the pressure chamber, and may not overlap with the piezoelectric layer. Accordingly, it is possible to further increase an amount of increase in the volume of the pressure chamber when the electric potential difference is generated between the individual electrode and the common electrode.

In the liquid-droplet jetting apparatus of the present invention, a length of the thinned portion in the predetermined direction may be greater than the length of the piezoelectric layer in the predetermined direction. Accordingly, it is possible to increase even further an amount of increase in the volume of the pressure chamber when the electric potential difference is generated between the individual electrode and the common electrode.

In the liquid-droplet jetting apparatus of the present invention, the length of the thinned portion in the predetermined direction may be not less than half the length of the pressure chamber in the predetermined direction. Accordingly, it is possible to further increase an amount of increase in the volume of the pressure chamber when the electric potential difference is generated between the individual electrode and the common electrode.

According to a third aspect of the present invention, there is provided a liquid transporting apparatus which transports a liquid, the apparatus including:

a channel unit which includes a pressure chamber; and a piezoelectric actuator which changes a volume of the pressure chamber to apply a pressure to a liquid in the pressure chamber, and which includes a plate arranged on one surface of the channel unit so as to cover the pressure chamber; a piezoelectric layer arranged at an area facing the pressure chamber such that the piezoelectric layer is extended in a predetermined direction from one edge of the pressure chamber in the predetermined direction, the area being on a surface of the plate on a side opposite to the pressure chamber; an individual electrode arranged on one surface of the piezoelectric layer; and a common electrode arranged on the other surface of the piezoelectric layer;

wherein a length of a portion in the predetermined direction, of the piezoelectric layer, which faces the pressure chamber is smaller than half a length of the pressure chamber in the predetermined direction.

According to the third aspect of the present invention, in a case of performing a so-called pulling ejection, in which volume of the pressure chamber is made to return to its original volume after increasing the volume once, thereby transporting a liquid from a nozzle, it is not necessary to generate in advance an electric potential difference between individual electrode and the common electrode when the liquid is not transported. Therefore, it is possible to improve the durability of the piezoelectric layer and to reduce the electric power consumption. However, if the length of the piezoelectric layer in the predetermined direction is excessively long, an intermediate portion of a portion, of the plate, in which the piezoelectric layer is arranged, is dented toward the pressure chamber, and thus the volume of the pressure chamber is decreased. Therefore, it is desirable that the length of the piezoelectric layer in the predetermined direction is smaller than half the length of the pressure chamber in the predetermined direction.

According to a fourth aspect of the present invention, there is provided a liquid transporting apparatus which transports a liquid, the apparatus including:

a channel unit which includes a pressure chamber; and a piezoelectric actuator which changes a volume of the pressure chamber to apply a pressure to a liquid in the pressure chamber, and which includes a plate arranged on one surface of the channel unit so as to cover the pressure chamber and having a surface with insulating property, the surface being on a side opposite to the pressure chamber; a piezoelectric layer arranged at an area facing the pressure chamber such that the piezoelectric layer is extended in a predetermined direction from one edge of the pressure chamber in the predetermined direction, the area being on a surface of the plate on a side opposite to the pressure chamber; an individual electrode arranged on one surface of the piezoelectric layer; and a common electrode arranged on the other surface of the piezoelectric layer;

wherein a length of a portion in the predetermined direction, of the piezoelectric layer, which faces the pressure chamber is smaller than half a length of the pressure chamber in the predetermined direction; and a wiring connected to the individual electrode is formed in an area in which the piezoelectric layer is absent, the area being on the surface of the plate on the side opposite to the pressure chamber.

In the area of the plate overlapping with the pressure chamber, there is a portion in which the piezoelectric layer is absent (the piezoelectric layer is not formed or arranged). Therefore, in a case that the surface of the plate (such as a vibration plate) on the side opposite to the pressure chamber has an insulating property, it is possible to arrange a wiring also in the portion in which the piezoelectric layer is not formed. Consequently, the degree of freedom of arranging the wiring, for applying the voltage to the individual electrode, becomes higher on the surface of the plate on the side opposite to the pressure chamber. In other words, when there are a large number of individual electrodes (or pressure chambers), the wirings can be arranged highly densely. Further, by forming the wiring in the portion in which the piezoelectric layer is not formed, it is possible to prevent the generation of an excessive electrostatic capacitance due to the wiring, and to decrease loss of energy.

BRIEF DESCRIPTION OF THE DRAWINGS

FIG. 10A to FIG. 10H are diagrams showing a simulation model for determining a width of a recess in FIG. 5;

DETAILED DESCRIPTION OF THE PREFERRED EMBODIMENTS

Exemplary embodiment of the present invention will be explained below with reference to the diagrams. This embodiment is an example in which the present invention is applied to an ink-jet printer which performs printing on a recording paper by discharging ink from a nozzle.

Figure 1:
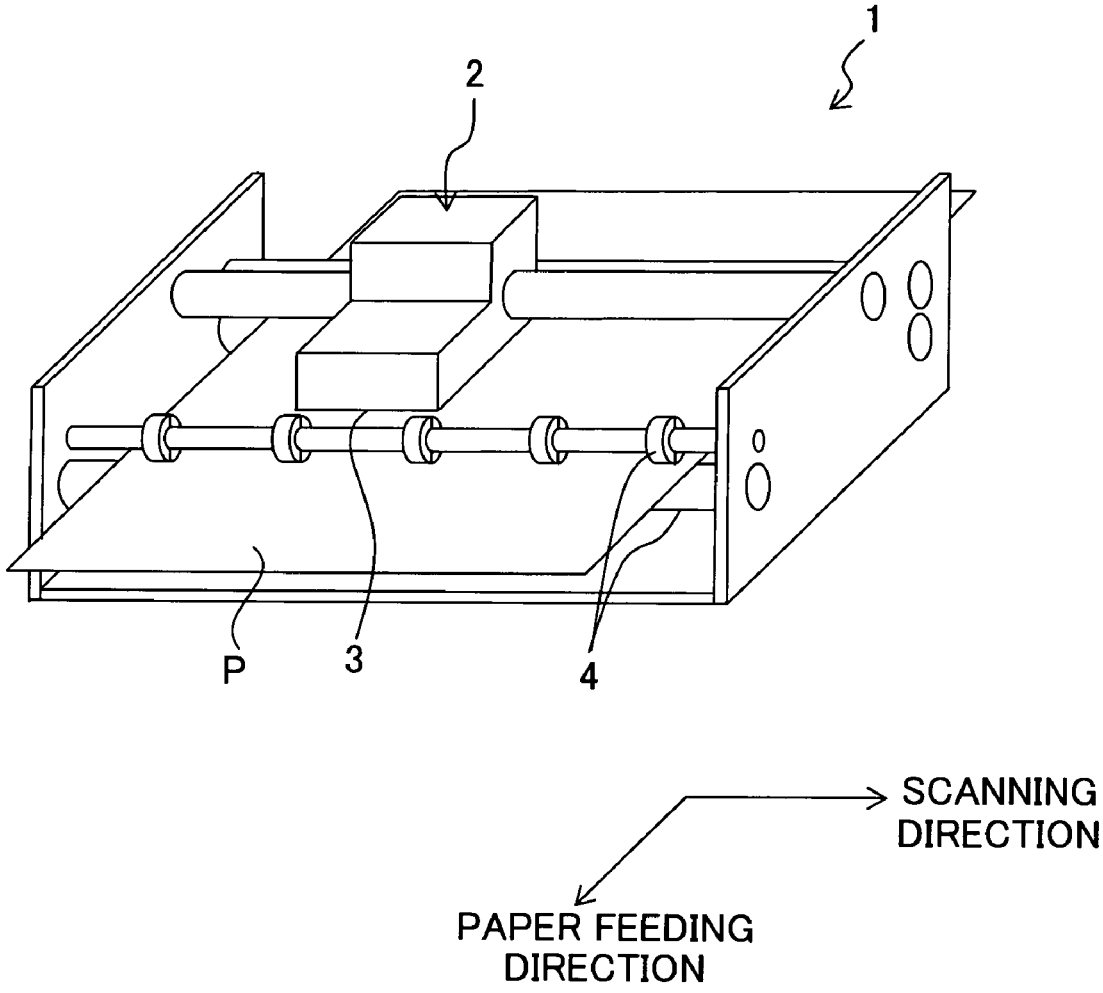
FIG. 1 is a schematic perspective view of an ink-jet printer according to an embodiment of the present invention.

FIG. 1 is a schematic perspective view of an ink-jet printer according to the embodiment. As shown in FIG. 1, an ink-jet printer 1 includes a carriage 2 which is movable in a scanning direction (left and right direction in FIG. 1), an ink-jet head 3 of serial type which is provided to the carriage 2 and discharges ink onto a recording paper P, and transporting rollers 4 which transport or carry the recording paper P in a forward direction in FIG. 1 (paper feeding direction). The ink-jet head 3 moves integrally with the carriage 2 and performs printing by discharging the ink onto the recording paper P from nozzles 15 (see FIG. 2) provided on a lower surface of the ink-jet head 3. Further, the recording paper P with an image or a letter printed thereon by the ink-jet head 3 is discharged in the paper feeding direction by the transporting rollers 4.

Figure 2:
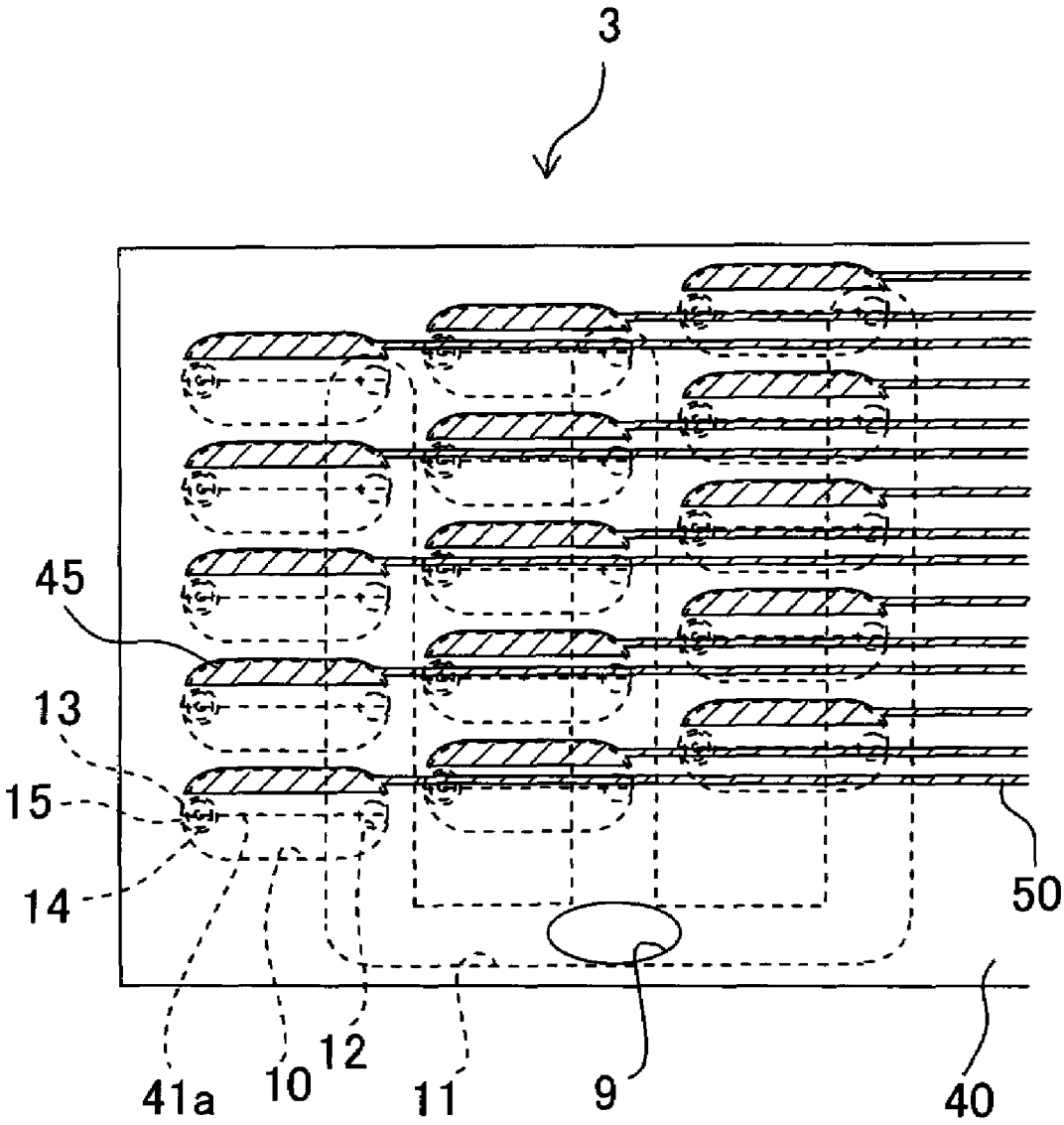
FIG. 2 is a plan view of an ink-jet head in FIG. 1.
Figure 3:
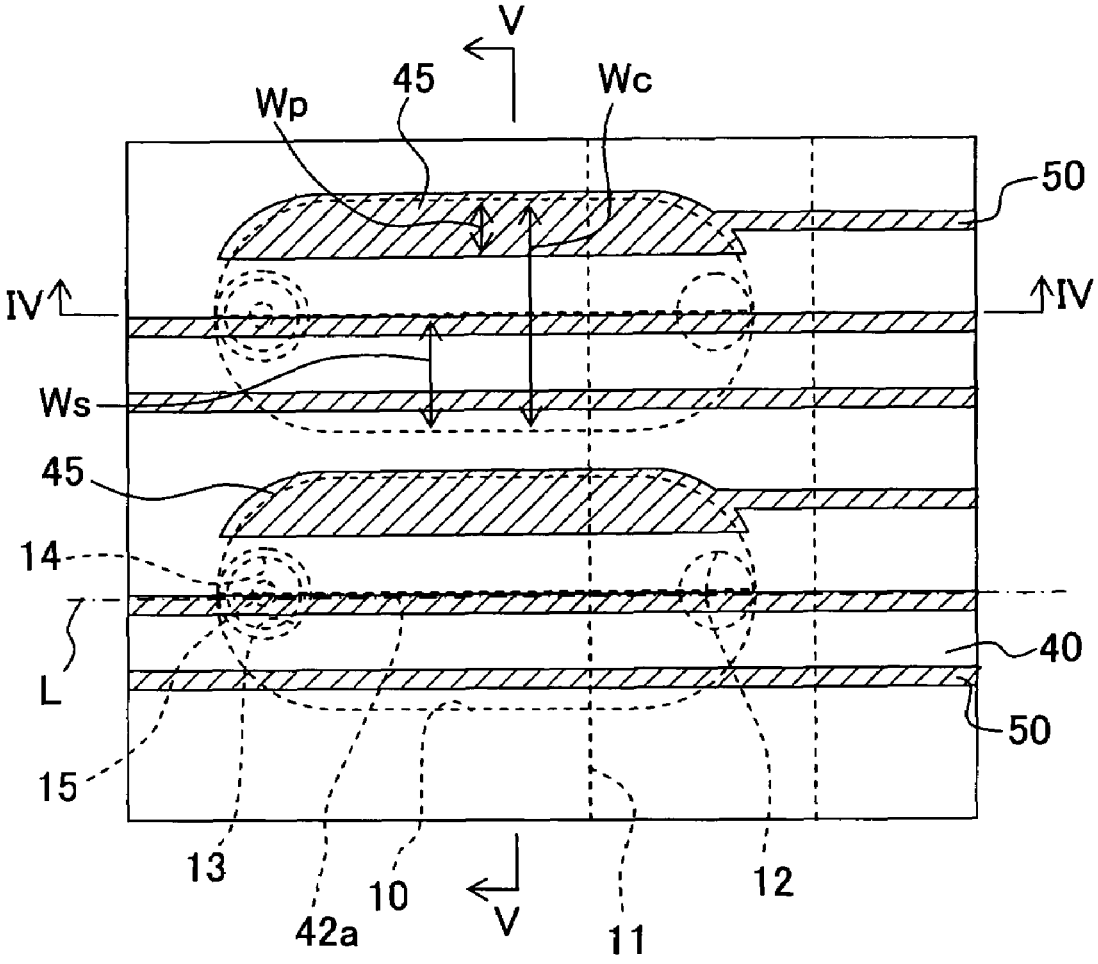
FIG. 3 is a partially enlarged view of FIG. 2.
Figure 4:
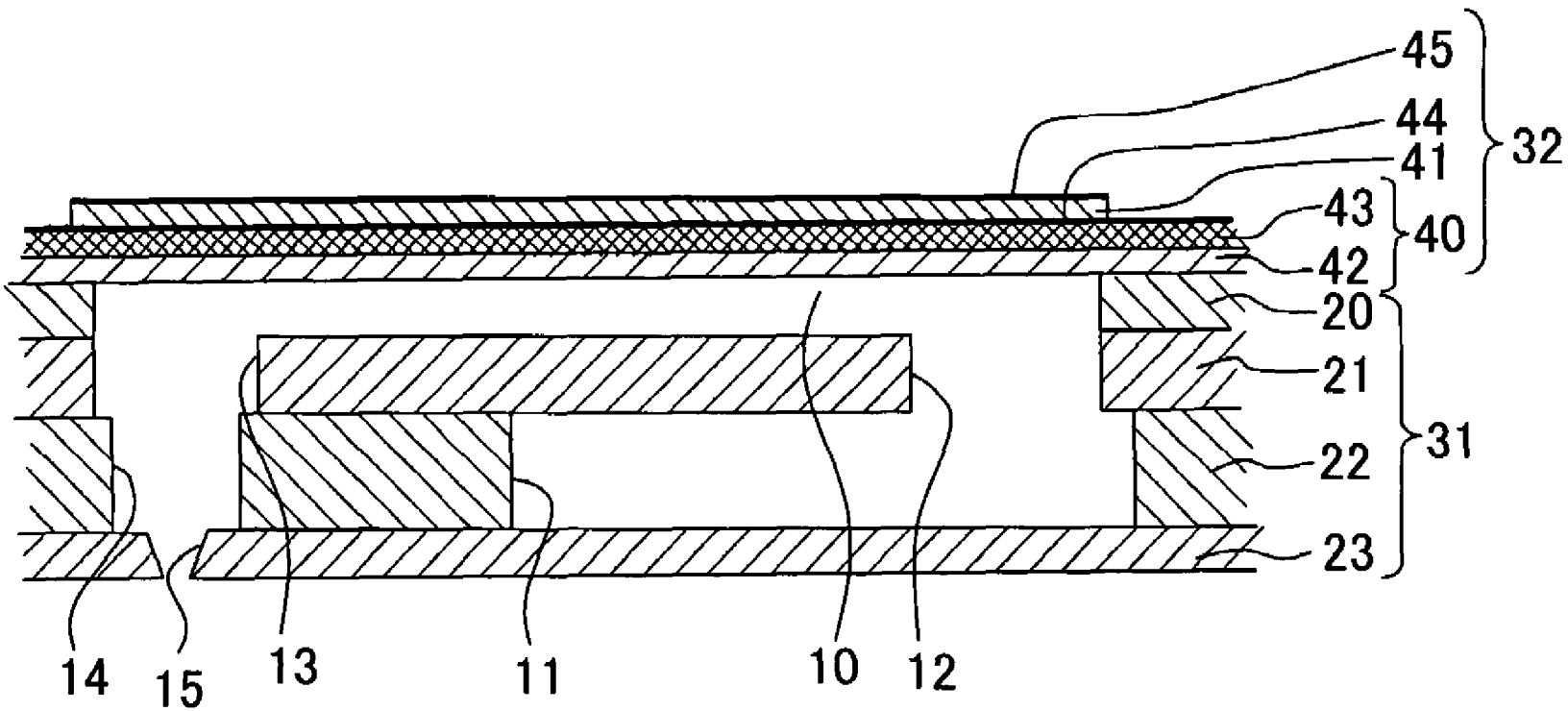
FIG. 4 is a cross-sectional view taken along a line IV-IV shown in FIG. 3.
Figure 5:
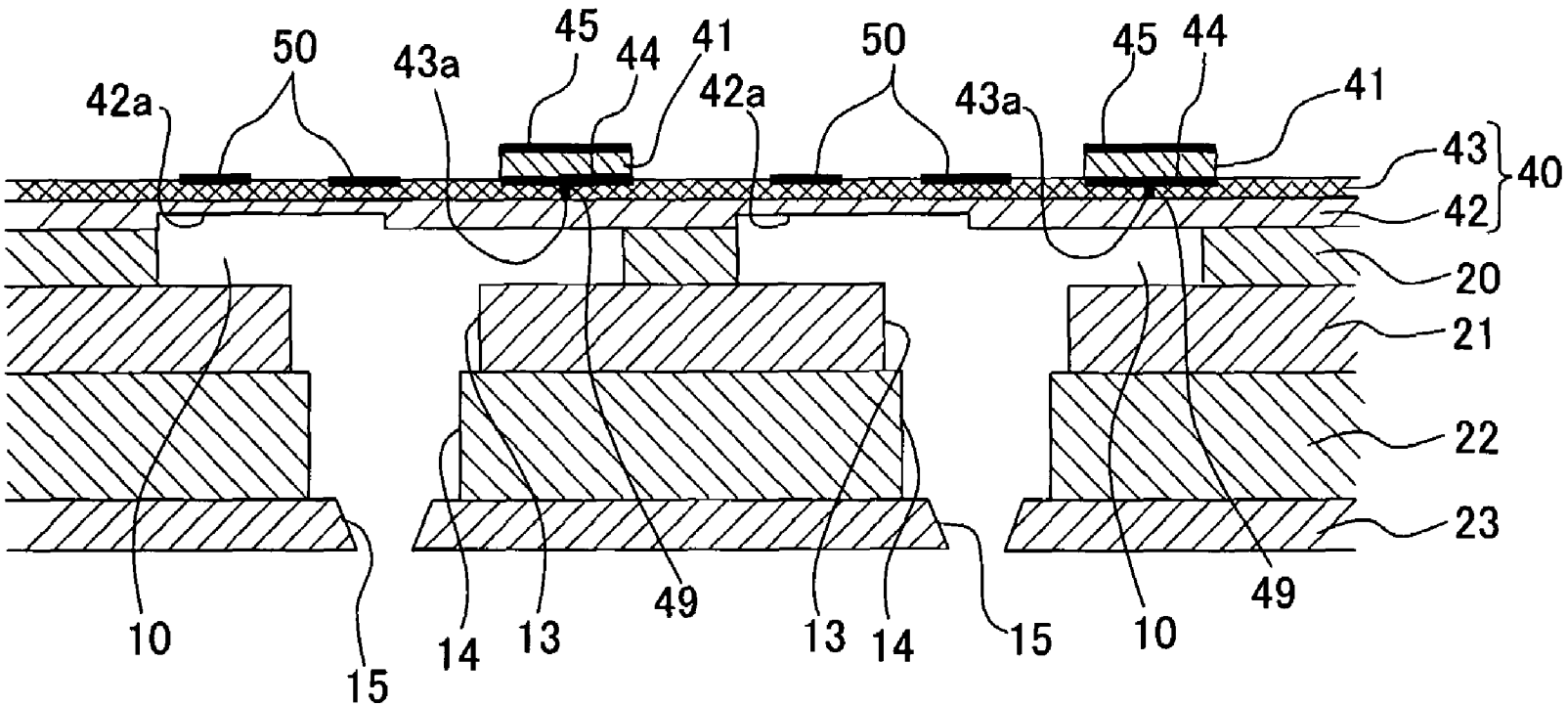
FIG. 5 is a cross-sectional view taken along a line V-V shown in FIG. 3.

Next, the ink-jet head 3 will be explained with reference to FIGS. 2 to 5. FIG. 2 is a plan view of the ink-jet head 3. FIG. 3 is a partially enlarged view of FIG. 2. FIG. 4 is a cross-sectional view taken along a line IV-IV shown in FIG. 3. FIG. 5 is a cross-sectional view taken along a line V-V shown in FIG. 3. As shown in FIGS. 2 to 5, the ink-jet head 3 includes a channel unit 31 in which a plurality of individual ink channels each including a pressure chamber 10 is formed, and a piezoelectric actuator 32 which is arranged on an upper surface of the channel unit 31.

The channel unit 31, as shown in FIGS. 4 and 5, includes a cavity plate 20, a base plate 21, a manifold plate 22, and a nozzle plate 23, and these four plates 20 to 23 are joined in stacked layers. Among these four plates, three plates, namely the cavity plate 20, the base plate 21, and the manifold plate 22 are formed of a metallic material such as stainless steel, and an ink channel such as a pressure chamber 10 and a manifold 11 which will be explained later are formed in these three plates 20 to 22 by a method such as an etching. Further, the nozzle plate 23 is made of a high-molecular synthetic resin material such as polyimide, and is joined to a lower surface of the manifold plate 22. Alternatively, the nozzle plate 23 may also be formed of a metallic material such as stainless steel, similar to the other three plates 20 to 22.

As shown in FIGS. 2 to 5, in the cavity plate 20, a plurality of pressure chambers 10 (15 pressure chambers, for example) arranged in three rows in the paper feeding direction is formed. As shown in FIG. 3, each of the pressure chambers 10 is formed to be substantially elliptical in shape and to be long in the scanning direction (left and right direction in FIG. 2) in a plan view. Furthermore, each of the pressure chambers 10 has a shape symmetrical with respect to a straight line L which passes through a center of gravity of each of the pressure chambers 10 and which is parallel to the scanning direction. In the embodiment, a direction of width (transverse direction, non-longitudinal direction) of the pressure chamber is made to be a predetermined direction, and a width Wc (length in the predetermined direction) of the pressure chamber 10 is approximately 300 μm.

Communicating holes 12 and 13 are formed in the base plate 21 at positions which overlap in a plan view with both end portions, respectively, in the longitudinal direction of each of the pressure chambers 10. The manifold 11 extending in the paper feeding direction is formed in the manifold plate 22. As shown in FIGS. 2 and 3, the manifold 11 is formed to overlap with roughly right halves of the pressure chambers 10 arranged in three rows. Further, the manifold 11 communicates with an ink supply port 9 formed in a vibration plate 40 which will be described later, and ink is supplied to the manifold 11 from the ink supply port 9. Further, a communicating hole 14 communicating with the communicating hole 13 is formed in the manifold plate 22, at an end portion in the longitudinal direction of each of the pressure chambers 10 in a plan view, the end portion being on a side opposite to the manifold 11.

Furthermore, nozzles 15 are formed in the nozzle plate 23 at positions overlapping with the communicating holes 14 respectively in a plan view. When the nozzle plate 23 is formed of a synthetic resin material, the nozzles 15 can be formed by an excimer laser process or the like, and when the nozzle plate 23 is formed of a metallic material, the nozzles 15 can be formed by a method such as press working.

The manifold 11 communicates with each of the pressure chambers 10 via one of the communicating holes 12. Further, each of the pressure chambers 10 communicates with one of the nozzles 15 via the communicating holes 13 and 14 respectively. Thus, in the channel unit 31, a plurality of individual ink channels each of which communicates with one of the nozzles 15 from the manifold 11 via one of the pressure chambers 10 is formed.

Next, the piezoelectric actuator 32 will be explained below. The piezoelectric actuator 32 includes the vibration plate 40 which is a plate (plate member) arranged on the upper surface of the channel unit 31, piezoelectric layers 41 arranged on an upper surface of the vibration plate 40 corresponding to the pressure chambers 10 respectively, individual electrodes 45 each arranged on the upper surface of one of the piezoelectric layers 41, and common electrodes 44 each arranged on the lower surface of one of the piezoelectric layers 41.

The vibration plate 40 includes an electroconductive substrate 42 which is a plate having a substantially rectangular shape and a thickness of approximately 20 μm, and an insulating layer 43 of a thickness of approximately 2 μm and formed on the upper surface of the electroconductive substrate 42. The upper surface of the vibration plate 40 has an insulating property. Here, the electroconductive substrate 42 is made of an iron alloy such as stainless steel, a copper alloy, a nickel alloy, a titanium alloy, or the like. Further, the electroconductive substrate 42 is arranged on the upper surface of the channel unit 31 so as to cover the pressure chambers 10, and is joined to the cavity plate 20. Further, a recess 42*a* is formed in the lower surface of the electroconductive substrate 42. The recess 42*a* extends from a portion facing one edge, of each of the pressure chambers 10, in a predetermined direction (edge on a left side in FIG. 5) toward the center in the width direction (predetermined direction) of each of the pressure chambers 10. The thickness of the portion, of the electroconductive substrate 42, in which the recess 42*a* is formed is less than a thickness of the other portion of the electroconductive substrate 42 (the portion of the electroconductive substrate 42 in which the recess 42*a* is formed has become a thinned portion). A width Ws of the recess 42*a* is approximately half the width Wc of the pressure chamber 10. In other words, the width Ws of the recess 42*a* is approximately 150 μm. Further, the electroconductive substrate 42 is kept at a ground electric potential all the time, and each of the common electrodes 44, which is connected to the electroconductive substrate 42 and which will be described later, is kept at the ground electric potential.

The insulating layer 43 is formed over an entire area on the surface of the electroconductive substrate 42. A through hole 43*a* penetrating through the insulating layer 43 is formed in a part of a portion of each of the insulating layers 43, the portion facing one of the pressure chambers 10, and an electroconductive material 49 is filled in the through hole 43*a*.

The piezoelectric layers 41 are formed at areas on the upper surface of the vibration plate 40, the areas overlapping in a plan view with the pressure chambers 10 respectively. Each of the piezoelectric layers 41 extends from a portion facing a right side edge of one of the pressure chambers 10 in FIG. 5 (an edge, of one of the pressure chambers 10, on a side opposite to the (other) edge facing the recess 42*a*, in the predetermined direction) toward the center of one of the pressure chambers 10 in the longitudinal direction. The piezoelectric layer 41 is mainly composed of lead zirconate titanate (PZT) which is a solid solution of lead titanate and lead zirconate, and is a ferroelectric substance. It is desirable that a width Wp of the piezoelectric layer 41 is shorter than half the width Wc of the pressure chamber 10, as will be described later. In this embodiment, the width Wp of the piezoelectric layer 41 is ¼ of the width Wc of the pressure chamber 10, namely approximately 75 μm. Further, with respect to the longitudinal direction of the pressure chamber 10, the piezoelectric layer 41 substantially covers the pressure chamber 10. The piezoelectric layer 41 can be formed by, for example, an aerosol deposition method (AD method) in which very fine particles of a piezoelectric material are blown onto a substrate and collided to the substrate at high velocity, to be deposited onto the substrate. Alternatively, the piezoelectric layer 41 can also be formed, for example, by a method such as a sputtering method, a chemical vapor deposition method (CVD method), a sol-gel method, or a hydrothermal synthesis method. Still alternatively, the piezoelectric layer 41 can also be formed by cutting, to a predetermined size, a piezoelectric sheet which is prepared by baking a green sheet of PZT, and sticking the cut piezoelectric sheet or sheets to the vibration plate 40.

Each of the common electrodes 44 and each of the individual electrodes 45 are formed on the upper surface and the lower surface, respectively, of one of the piezoelectric layers 41 to substantially cover the piezoelectric layer 41. The common electrode 44 and the individual electrode 45 are formed of an electroconductive material such as gold, copper, silver, palladium, platinum, or titanium. The common electrodes 44 are electrically connected to the electroconductive substrate 42 via the electroconductive material 49 filled in the through holes 43*a*, respectively, and are kept at the ground electric potential.

Further, in a portion, on the upper surface of the insulating layer 43, on which the piezoelectric layer 41 is not formed, a wiring 50 connected to each of the individual electrodes 45 is formed. The wiring 50 is extended, from the right end in the longitudinal direction of each of the individual electrodes 45 in FIG. 2, toward the right side in FIG. 2, and is connected to a driver IC which is not shown in the diagram. Further, electric potential of each of the individual electrodes 45 is controlled from the driver IC via one of the wirings 50.

Figure 6:
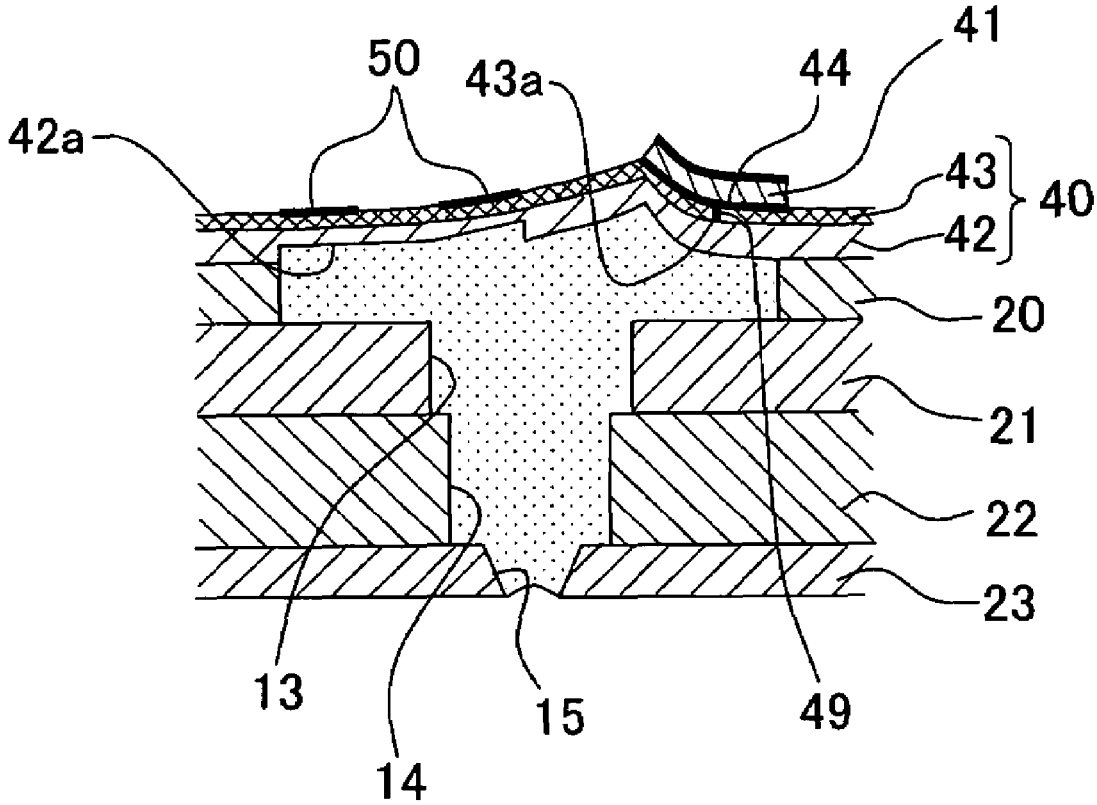
FIG. 6 is a diagram showing an action of a piezoelectric actuator in FIG. 5.

Next, an action of the piezoelectric actuator 32 will be explained with reference to FIG. 6. When an electric potential is selectively applied to the individual electrodes 45 from the driver IC, an electric potential difference is generated between an individual electrode 45 applied with the electric potential and a common electrode 44 corresponding to this individual electrode 45, and in a piezoelectric layer 41 sandwiched between the individual electrode 45 and the common electrode 44, an electric field in a direction of thickness of the piezoelectric layer 41 is generated. When a direction in which the piezoelectric layer 41 is polarized is same as the direction of the electric field, the piezoelectric layer 41 is contracted in a horizontal direction which is orthogonal to the thickness direction of the piezoelectric layer 41. Here, since a portion of the vibration plate 40 at the edge of the pressure chamber 10 is fixed to the cavity plate 20, a deformation of this portion is constrained. Therefore, as shown in FIG. 6, with the contraction of the piezoelectric layer 41, a left end portion, of a portion of the vibration plate 40 facing the piezoelectric layer 41, is deformed to warp or curve up toward a side opposite to the pressure chamber 10 (warp or curve upwardly). With the deformation of the portion of the piezoelectric layer 41, another portion of the vibration plate 40 disposed farther left than the piezoelectric layer 41 is pushed upward. However, if the width of the piezoelectric layer 41 is excessively great, an intermediate portion of a portion in a width direction of the vibration plate 40 overlapping with the piezoelectric layer 41 is lowered down toward the pressure chamber 10, and thus a volume of the pressure chamber 10 is decreased in some cases. Consequently, it is desirable that the width of the piezoelectric layer 41 is shorter than half the width of the pressure chamber 10 as described before. Further, the recess 42*a* is formed in the portion, of the electroconductive substrate 42, not facing the piezoelectric layer 41, and the thickness of the portion formed with the recess 42*a* is smaller than the other portion of the electroconductive substrate 42. Therefore, the vibration plate 40 is easily deformed at the portion in which the recess 42*a* is formed. The portion of the vibration plate 40 in which the recess 42*a* is formed is pushed upward substantially than in a case in which the recess 42*a* is not formed in the vibration plate 40. Accordingly, the volume of the pressure chamber 10 is increased, and the pressure of the ink in the pressure chamber 10 is decreased. Therefore, the ink flows from the manifold 11 into the pressure chamber 10.

Further, when the electric potential of the individual electrode 45 is made to return to the ground electric potential at a timing at which a negative pressure wave, generated in the pressure chamber 10 when the vibration plate 10 was deformed, is changed to a positive pressure wave, the deformation of the vibration plate 40 is released (vibration plate 40 regains an original shape before the deformation), and also the volume inside the pressure chamber 10 becomes the original volume. At this time, a pressure wave generated when the vibration plate 40 was deformed, and a pressure wave generated when the deformation of the vibration plate 40 is released are superposed, and the pressure in the pressure chamber 10 is increased. Therefore, the ink is discharged onto the recording paper P from the nozzle 15 communicating with the pressure chamber 10.

As explained above, an amount of a change in the volume of the pressure chamber 10 when the electric potential difference is generated between the individual electrode 45 and the common electrode 44 varies depending on, for example, the width of the pressure chamber 10, the width of the piezoelectric layer 41, and/or the width of the recess 42*a*. Depending on the selection of these widths, when the electric potential difference is generated between the individual electrode 45 and the common electrode 44, the volume of the pressure chamber 10 may rather be decreased in some cases. Therefore, a relationship among an amount of increase in the volume of the pressure chamber 10, when the electric potential difference is generated between the individual electrode 45 and the common electrode 44, and the width of the pressure chamber 10, the width of the piezoelectric layer 41, and the width of the recess 42*a*, will be explained with reference to FIGS. 7 to 11.

Figure 7:
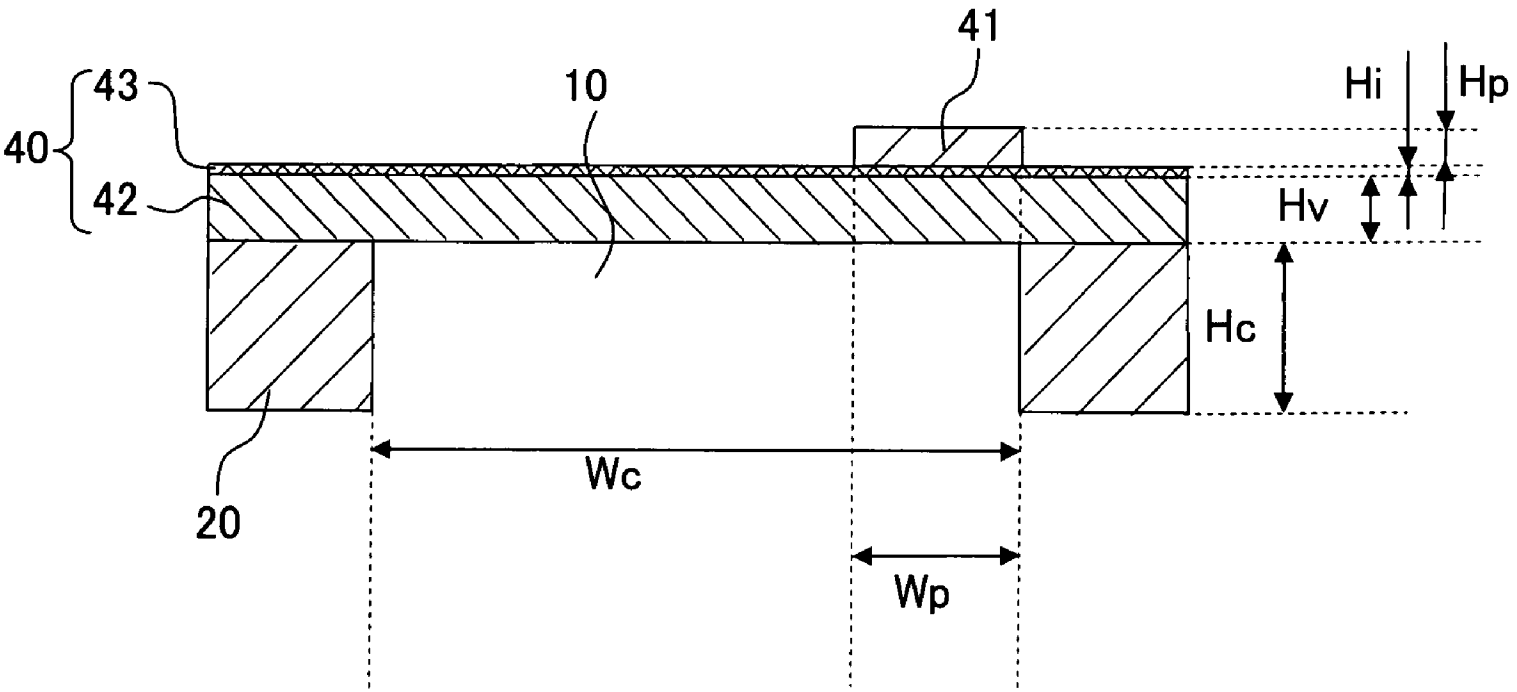
FIG. 7 is a diagram showing a simulation model for determining a width of a piezoelectric layer in FIG. 5.
Figure 8:
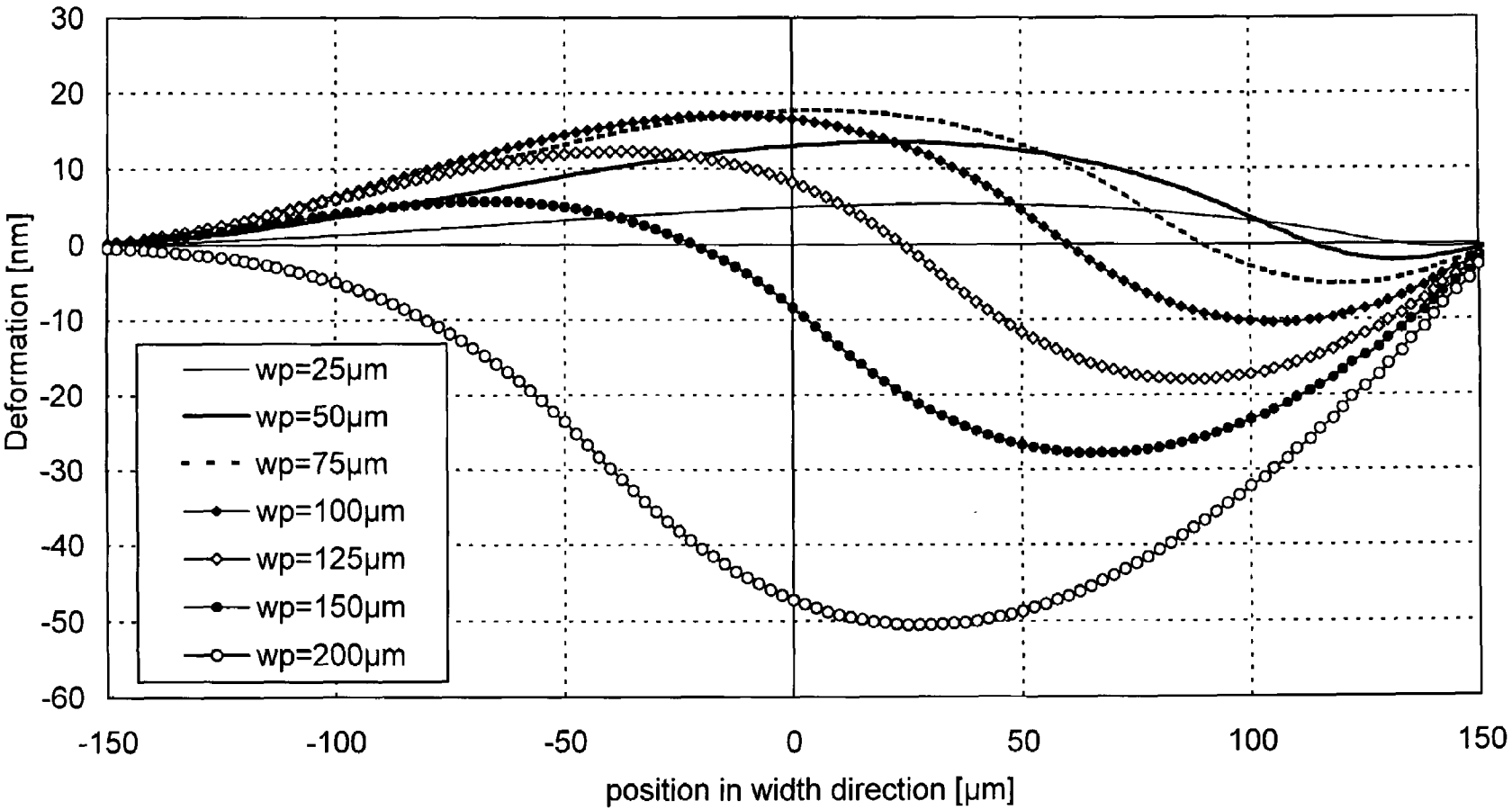
FIG. 8 is a diagram showing a simulation result in the simulation model of FIG. 7.
Figure 9:
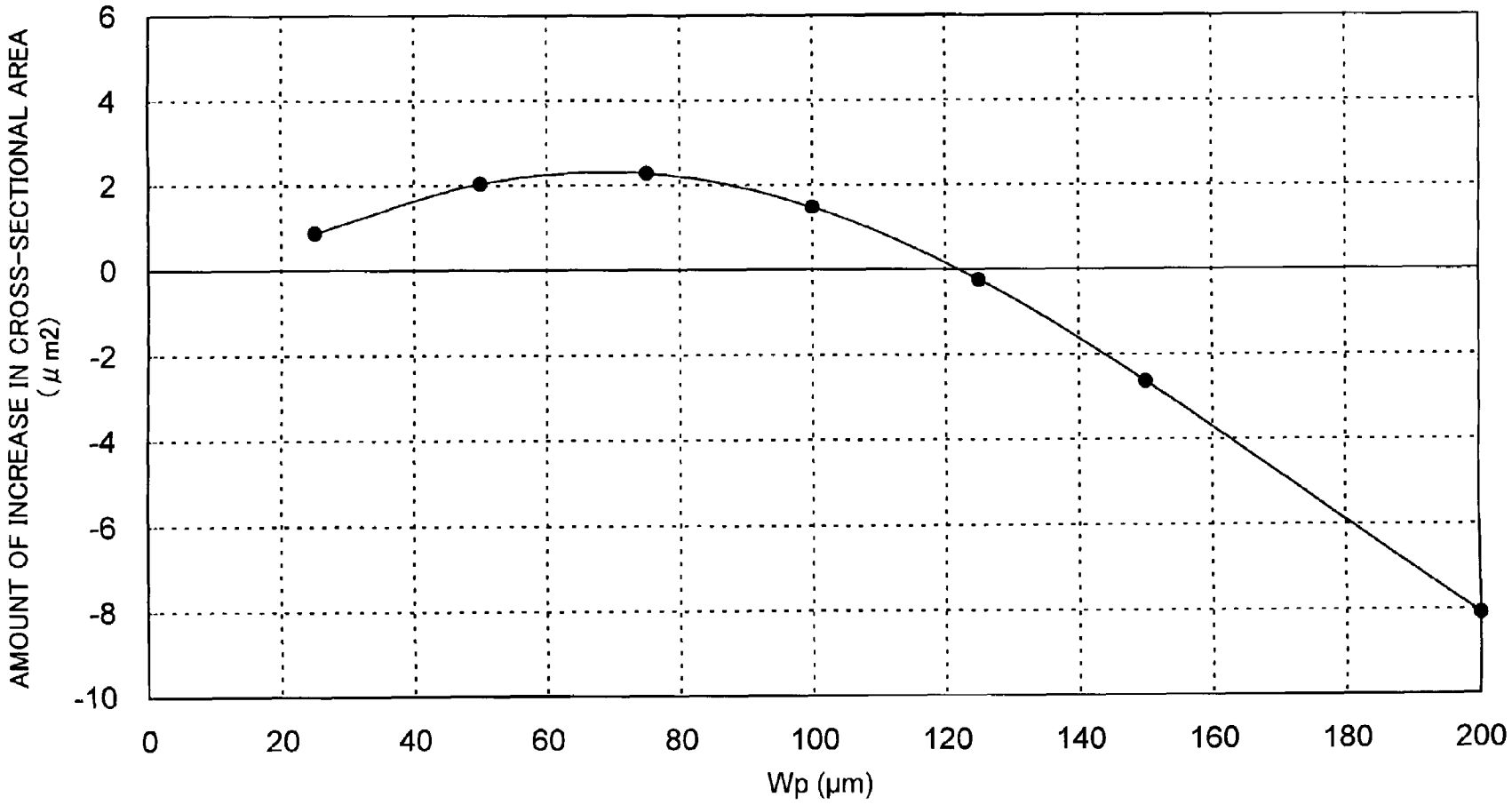
FIG. 9 is a diagram showing an analysis result obtained from the simulation result in FIG. 8.

As simulation models (hereinafter, "models") for obtaining the relationship among the width of the pressure chamber 10, the width of the piezoelectric layer 41, and the amount of increase in the volume of the pressure chamber 10, a cross-sectional surface as shown in FIG. 7 is taken into consideration. The cross-sectional surface shown in FIG. 7 includes a cavity plate 20, a vibration plate 40, a piezoelectric layer 41, a common electrode 44 (not shown in FIG. 7), and an individual electrode 45 (not shown in FIG. 7). The cavity plate 20 includes a pressure chamber 10 having a length Wc and a height Hc, the pressure chamber 10 being formed in the cavity plate 20. The vibration plate 40 includes an electroconductive substrate 42 having a thickness Hv and formed on the entire upper surface of the cavity plate 20, and an insulating layer 43 having a thickness Hi and formed on the entire upper surface of the electroconductive substrate 42. The piezoelectric layer 41 has a width Wp and a thickness Hp and is extended from one edge in a width direction of the pressure chamber 10 toward the width direction of the pressure chamber 10. The common electrode 44 has a thickness 0 (zero, not shown in FIG. 7) and is formed on the entire lower surface of the piezoelectric layer 41. The individual electrode 45 has a thickness 0 (zero, not shown in FIG. 7) and is formed on the entire upper surface of the piezoelectric layer 41. For such a cross-sectional surface, an amount of displacement (deformation) in an up and down direction at each point on the lower surface of the vibration plate 40, when the electric potential difference is generated between the individual electrode 45 and the common electrode 44 was obtained by simulation. The result of the simulation is shown in FIG. 8. A horizontal axis in FIG. 8 indicates a position in the pressure chamber 10 in the width direction of the pressure chamber, with the center of the pressure chamber 10 in the width direction as a point of origin, and a vertical axis indicates the amount of displacement (deformation) of the vibration plate 40 in the up and down direction. The pressure chamber 10 used in each of the models has a width Wc of 300 μm and a height Hc of 50 μm. The electroconductive substrate 42 in each of the models has a height Hv of 20 μm and the insulating layer 43 has a height Hi of 2 μm. The thickness Hp of the piezoelectric layer 41 is fixed to be 10 μm for each of the models, and the widths of the piezoelectric layer 41 are 25 μm, 50 μm, 75 μm, 100 μm, 125 μm, 150 μm, and 200 μm in the models, respectively. The electric potential difference between the individual electrode 45 and the common electrode 44 is 20 (V). Each of graphs in FIG. 8 shows the amount of displacement of the vibration plate 40 in the up and down direction with respect to the position of the pressure chamber 10 in the width direction of the pressure chamber 10, when the width Wp of the piezoelectric layer 41 is set to one of the widths described above. By integrating the result shown in FIG. 8 in the width direction of the pressure chamber 10 (left and right direction in FIG. 7), it is possible to calculate (obtain) the amount of increase in the cross-sectional area of the pressure chamber 10 in this cross-sectional area, caused by the deformation of the vibration plate 40, as shown in FIG. 9. Here, as the amount in increase of the cross-sectional area is greater, the amount of increase in the volume of the pressure chamber 10 becomes greater. Further, when the amount of increase in the volume of the pressure chamber 10 is a negative value, the volume of the pressure chamber 10 is decreased.

As shown in FIG. 9, when the width Wp of the piezoelectric layer 41 is excessively great (in this simulation pattern, Wp>120 μm), the amount of increase in the cross-sectional area of the pressure chamber 10 becomes a negative value, and the volume of the pressure chamber 10 is consequently decreased due to the deformation of the vibration plate 40. Therefore, in this case, it is not possible to perform the pulling ejection.

Furthermore, from the simulation result shown in FIG. 9, when the width of the piezoelectric layer 41 is in a range of 25 μm to 100 μm, in other words, when the width of the piezoelectric layer 41 is in a range of 1/12 of the width of the pressure chamber 10 to 1/3 of the width of the pressure chamber 10, the amount of increase in the cross-sectional area is assuredly a positive value, and in this range, the volume of the pressure chamber 10 is increased assuredly due to the deformation of the vibration plate 40. Furthermore, in particular, when the width Wp of the piezoelectric layer 41 is 75 μm, in other words, when the width Wp of the piezoelectric layer 41 is 1/4 of the width Wc of the pressure chamber 10, the amount of increase in the cross-sectional area is particularly substantial. Consequently, in this embodiment, the piezoelectric layer 41 was formed such that the width Wp of the piezoelectric layer 41 becomes approximately 1/4 of the width Wc of the pressure chamber 10.

Next, the following simulation was performed for obtaining a relationship among the width of the pressure chamber 10, the width of the recess 42*a*, and the increase in the volume of the pressure chamber 10. Similarly as in the cross-sectional area in FIG. 7, vibration plates 40 in which recesses 42*a* are formed in the lower surface as shown in FIGS. 10A to 10H, respectively, were assumed or considered. Then, in each of such cross-sectional areas, an amount of change in the lower surface of the vibration plate 40 in the up and down direction, when the electric potential difference is generated between the individual electrode 45 and the common electrode 44, was obtained by the simulation in a similar manner as described above. The result of the simulation was integrated in a similar manner as described above, and the amount of increase in the cross-sectional area of the pressure chamber 10 due to the deformation of the vibration plate 40 was calculated.

In each of such models, a width Wc of the pressure chamber 10 was fixed to be 300 μm, a height Hc of the pressure chamber 10 was fixed to be 50 μm; a thickness Hv of the electroconductive substrate 42 was fixed to be 20 μm; a height Hi of the insulating layer 43 was fixed to be 2 μm; a thickness Hp of the piezoelectric layer 41 was fixed to be 10 μm, a width Wp of the piezoelectric layer 41 was fixed to be 75 μm; and a depth Hs of the recess 42*a* was fixed to be 10 μm. With such settings, for the models, a width Ws of the recess 42*a* and a position at which the recess 42*a* was formed were changed as shown in FIGS. 10A to 10H, and the simulation was performed with the electrical potential difference between the individual electrode 45 and the common electrode 44 to be 20 (V). Here, FIG. 10A shows a case in which the recess 42*a* is not formed in the lower surface of the electroconductive substrate 42. FIG. 10B shows a case in which the recess 42*a* is formed entirely on a portion on the lower surface of the electroconductive substrate 42, the portion facing the pressure chamber 10. FIGS. 10C, 10D, and 10E show cases in which the recesses 42*a* are formed such that the widths Ws of the recess 42*a* are 75 μm, 150 μm, and 225 μm respectively, the width Ws being measured from an edge on the lower surface of the electroconductive substrate 42, the edge being on a side opposite to the other edge overlapping with the piezoelectric layer 41. FIGS. 10F, 10G, and 10H show cases in which the recesses 42*a* are formed such that the width Ws of the recesses 42*a* are 75 μm, 150 μm, and 225 μm respectively, the width Ws being measured from an edge on the lower surface of the electroconductive substrate 42, the edge being on a side overlapping with the piezoelectric layer 41.

Figure 11:
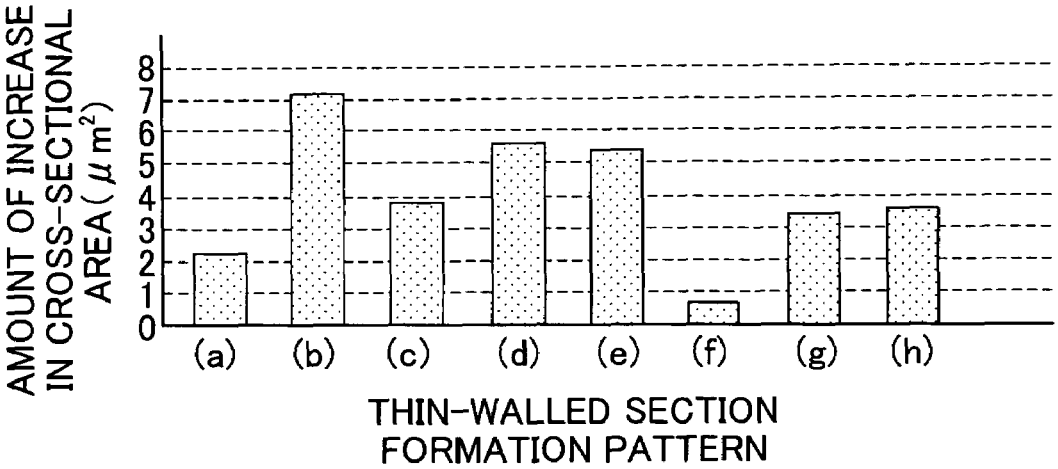
FIG. 11 is a diagram showing a simulation result in the simulation model in FIG. 10.

Reference symbols (a) to (h) in FIG. 11 indicate the amounts of increase in the cross-sectional area of the pressure chamber 10, in the simulation based on the models in FIGS. 10A to 10H. As shown in FIG. 11, in each of the models in FIGS. 10B to 10H, except for the model in FIG. 10F, the amount of increase in the cross-sectional area of the pressure chamber 10 is greater than an amount of increase in model in FIG. 10A in which the recess 42*a* is not formed on the lower surface of the electroconductive substrate 42. In other words, when the recess 42*a* is formed in an area, of the electroconductive substrate 42, not overlapping at least partially with the piezoelectric layer 41 in a plan view, the amount of increase in the volume of the pressure chamber 10 is greater than an amount of increase in the case in which the recess 42*a* is not formed.

Furthermore, particularly in the models of FIGS. 10C, 10D, and 10E, the amount of increase in the cross-sectional area of the pressure chamber 10 is great. In other words, when the recess 42*a* is formed, in the lower surface of the electroconductive substrate 42, to be extended, toward the center of the pressure chamber 10 in the width direction of the pressure chamber, from an edge of the pressure chamber 10 in the direction of width, the edge being on a side opposite to the other edge of the pressure chamber on a side overlapping with the piezoelectric layer 41, and when the recess 42*a* is formed in the lower surface of the electroconductive substrate 42, such that the recess 42*a* does not face the piezoelectric layer 41, the amount of increase in the volume of the pressure chamber is great.

Furthermore, in particular, in each of the models of FIGS. 10D and 10E, the amount of increase in the cross-sectional area of the pressure chamber 10 is great. In other words, when the recess 42*a* is extended in the lower surface of the electroconductive substrate 42, toward the center of the pressure chamber 10 in the width direction of the pressure chamber, from the edge of the pressure chamber 10 in the width direction of the pressure chamber, the edge being on the side opposite to the other edge of the pressure chamber overlapping with the piezoelectric layer 41, and when the width Ws of the recess 42*a* is not less than half the width Wc of the pressure chamber 10, the amount of increase in the volume of the pressure chamber 10 is particularly great. Further, in this case, the width Ws of the recess 42*a* is greater than the width Wp of the piezoelectric layer 41.

In the result shown in FIG. 11, as in the model shown in FIG. 10B, when the recess 42*a* is formed in the lower surface of the electroconductive substrate 42 on the entire area overlapping with the pressure chamber 10 in a plan view, the amount of increase in the volume of the pressure chamber 10 is the greatest. However, in this case, since the strength of the vibration plate 40 is declined. Accordingly, in this embodiment, the recess 42*a* is formed in the lower surface of the electroconductive substrate 42, such that the recess 42*a* is extended from an edge of the pressure chamber 10 in the width direction of the pressure chamber, the edge being on the side opposite to the other edge of the pressure chamber overlapping with the piezoelectric layer 41, and that the width Ws of the recess 42*a* is approximately half the width Wc of the pressure chamber 10.

According to the embodiment described above, the piezoelectric layer 41 is arranged to be extended from the area on the upper surface of the vibration plate 40 toward the center of the pressure chamber 10 in the width direction thereof, the area overlapping with one edge of the pressure chamber 10 in the width direction of the pressure chamber, and the width of the piezoelectric layer 41 is ¼ of the width of the pressure chamber 10. Therefore, when the electric potential difference is generated between the individual electrode 45 and the common electrode 44, the portion of the piezoelectric layer 41 sandwiched between the individual electrode 45 and the common electrode 44 is deformed. Due to the deformation of the vibration plate 40 accompanying with the deformation of the portion of the piezoelectric layer 41, the volume of the pressure chamber 10 is increased. In this case, in the ink-jet head 3, it is not necessary, for performing the pulling ejection, to generate in advance the electric potential difference between the individual electrode 45 and the common electrode 44. Therefore, the durability of the piezoelectric layer 41 is improved, and it is possible to decrease the electric power consumption of the ink-jet head 3.

Further, it is possible to form the wiring 50 also in a portion in which the piezoelectric layer 41 is not formed, this portion being included in the portion on the surface of the insulating layer 43 overlapping with the pressure chamber 10. Accordingly, even when the pressure chambers 10 are formed in the channel unit 31, it is possible to arrange the wirings 50 highly densely in the surface of the insulating layer 43. In particular, when the pressure chambers 10 are arranged in a large number of rows, for example, in not less than 3 rows, it is possible to easily provide the wiring required, for an individual electrode 45 corresponding to a pressure chamber 10 arranged in an inner row of the rows. Furthermore, since the wiring 50 is not formed on the surface of the piezoelectric layer 41, it is possible to prevent generation of an excessive electrostatic capacitance in the piezoelectric layer 41 due to the wiring 50, thereby decreasing the loss of energy.

Further, the recess 42*a* is formed in the lower surface of the electroconductive substrate 42 of the vibration plate 40, the recess 42*a* having a width half the width of the pressure chamber 10 and extending from the other edge of the pressure chamber 10 in the width direction thereof (edge on the side not overlapping with the piezoelectric layer 41) toward the center of the pressure chamber 10 in the width direction thereof. Accordingly, the vibration plate 40 is easily deformed at a portion in which the recess 42*a* is formed, and when the electric potential difference is generated between the individual electrode 45 and the common electrode 44, the amount of increase in the volume of the pressure chamber 10 becomes great. In this case, it is not necessarily indispensable that the recess 42*a* is formed in the lower surface of the vibration plate 40, and the recess 42 may be formed, for example, in the upper surface of the vibration plate 40.

Next, modified embodiments in which various changes are made to the embodiment will be explained. Same reference numerals will be given to parts or components having similar construction as those in the embodiment, and explanation therefor will be omitted as appropriate.

First Modified Embodiment

Figure 12:
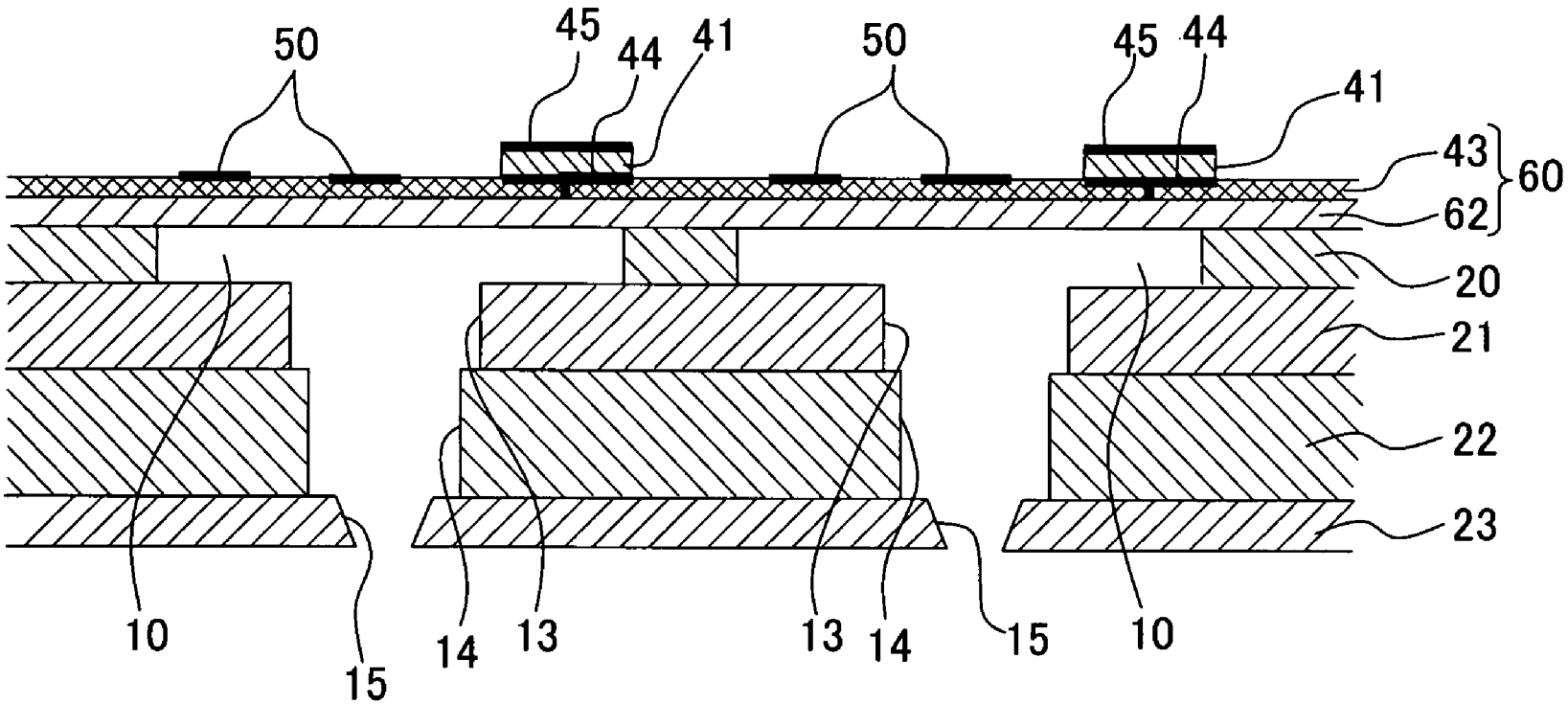
FIG. 12 is a cross-sectional of a first modified embodiment, view corresponding to FIG. 5.

As shown in FIG. 12, any recess may not be formed on a lower surface of an electroconductive substrate 62 of a vibration plate 60, and a thickness of the electroconductive substrate 62 may be uniform. In this case also, according to the result of stimulation shown in FIGS. 7 and 9, it is possible to generate the electric potential difference between the individual electrode 45 and the common electrode 44 to deform the vibration plate 60, thereby increasing the volume of the pressure chamber 10. Accordingly, it is possible to perform the pulling ejection without previously deforming the vibration plate 60 by generating the electric potential difference between the individual electrode 45 and the common electrode 44.

Second Modified Embodiment

Figure 13:
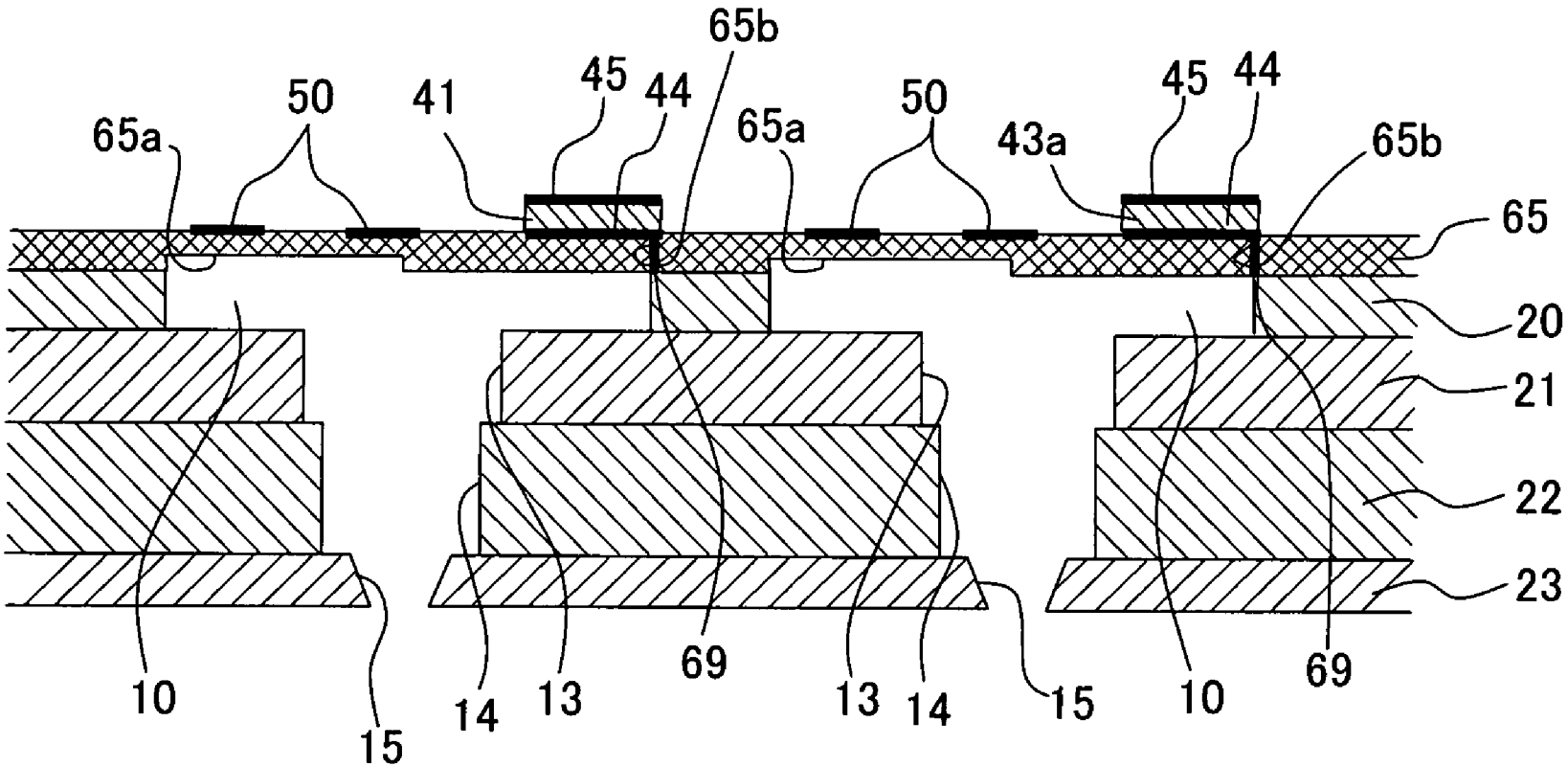
FIG. 13 is a cross-sectional view of a second modified embodiment, corresponding to FIG. 5.

A vibration plate 65 may be formed of an insulating material as shown in FIG. 13. In this case also, it is possible to form the wiring 50 in a portion not overlapping with the piezoelectric layer 41, the portion included in an area overlapping with the pressure chamber 10 and on a surface of the vibration plate 65. Accordingly, the wirings 50 can be arranged highly densely. Further, in this case, a recess 65*a* is formed in the area, on the lower surface of the vibration plate 65, which overlaps with each of the pressure chambers 10. The recess 65*a* extends, from an edge of each of the pressure chambers 10 in the width direction thereof, toward the center of the pressure chamber 10 in the width direction thereof, the edge being on the side opposite to the other edge, of the pressure chamber, which overlaps with the piezoelectric layer 41. Thus, a portion of the vibration plate 65, in which the recess 65*a* is formed, is easily deformed. Furthermore, a through hole 65*b* is formed in a portion of the vibration plate 65 overlapping with each of the common electrodes 44, and each of the common electrodes 44 and the cavity plate 20 are electrically connected by an electroconductive material 69 filled in the through hole 65*b*. Further, each of the common electrodes 44 is kept at the ground electric potential by keeping the cavity plate 20 at the ground electric potential.

Further, a shape of the pressure chamber in a plan view is not limited to the elliptical shape as in the embodiment, and may be any shape such as a circular shape, an oval shape, a rhombus shape, a rectangular shape, a parallelogram shape or the like.

In the embodiment and the modified embodiments of the present invention, the examples in each of which the present invention is applied to the ink-jet printer are explained. However, in addition to these, the present invention is also applicable to a liquid-droplet jetting apparatus which jets a liquid other than ink, such as a reagent, a biomedical solution, a wiring-material solution, an electronic-material solution, a cooling medium (refrigerant), a fuel, and the like. Further, the present invention is also applicable to a liquid transporting apparatus which transports the liquids as described above and has no nozzle.

What is claimed is:

1. A liquid-droplet jetting apparatus which jets liquid droplets, the apparatus comprising:

a channel unit which includes a pressure chamber communicating with a nozzle; and a piezoelectric actuator which changes a volume of the pressure chamber to apply a pressure to a liquid in the pressure chamber, and which includes a plate arranged on one surface of the channel unit so as to cover the pressure chamber; a piezoelectric layer arranged at an area, of the plate, overlapping with the pressure chamber such that the piezoelectric layer covers one edge of the pressure chamber in a predetermined direction and the piezoelectric layer is extended in the predetermined direction from a position overlapping with the one edge of the pressure chamber, the area being on a surface of the plate on a side opposite to the pressure chamber; an individual electrode arranged on one surface of the piezoelectric layer; and a common electrode arranged on the other surface of the piezoelectric layer;

wherein a length in the predetermined direction of a portion, of the piezoelectric layer, which faces the pressure chamber is shorter than half a length of the pressure chamber in the predetermined direction.

2. The liquid-droplet jetting apparatus according to claim 1, wherein the pressure chamber has a shape symmetrical with respect to a straight line passing through a center of gravity of the pressure chamber and orthogonal to the predetermined direction.

3. The liquid-droplet jetting apparatus according to claim 1, wherein the pressure chamber has an elongated shape, and the predetermined direction is a traverse direction of the pressure chamber.

4. The liquid-droplet jetting apparatus according to claim 1, wherein the length in the predetermined direction of the portion, of the piezoelectric layer, which faces the pressure chamber is in a range of 1/12 to 1/3 of the length of the pressure chamber in the predetermined direction.

5. The liquid-droplet jetting apparatus according to claim 4, wherein the length in the predetermined direction of the portion, of the piezoelectric layer, which faces the pressure chamber is 1/4 of the length of the pressure chamber in the predetermined direction.

6. A liquid-droplet jetting apparatus which jets liquid droplets, the apparatus comprising:

a channel unit which includes a plurality of pressure chambers communicating with nozzles, respectively; and a piezoelectric actuator which changes a volume of at least one of the pressure chambers to apply a pressure to a liquid in the at least one of the pressure chambers, and which includes a plate arranged on one surface of the channel unit so as to cover the pressure chambers and having a surface with insulating property, the surface being on a side opposite to the pressure chambers; a piezoelectric layer arranged at areas, of the plate, overlapping with the pressure chambers such that the piezoelectric layer covers one edge of one of the pressure chambers in a predetermined direction and that the piezoelectric layer is extended in the predetermined direction from a position overlapping with the one edge of the one of the pressure chambers, the areas being on the surface of the plate on the side opposite to the pressure chambers; individual electrodes arranged on one surface of the piezoelectric layer corresponding to the areas; and a common electrode arranged on the other surface of the piezoelectric layer;

wherein the plurality of pressure chambers includes a first pressure chamber and a second pressure chamber, a length in the predetermined direction of a portion, of the piezoelectric layer, which faces the first pressure chamber is shorter than half a length of the first pressure chamber in the predetermined direction; and a wiring connected to an individual electrode for the second pressure chamber of the individual electrodes is formed in an area, of the plate, which overlaps with the first pressure chamber and in which the piezoelectric layer is absent, the area being on the surface of the plate on the side opposite to the first pressure chamber.

7. The liquid-droplet jetting apparatus according to claim 6, wherein each of the pressure chambers has a shape symmetrical with respect to a straight line passing through a center of gravity of one of the pressure chambers and orthogonal to the predetermined direction.

8. The liquid-droplet jetting apparatus according to claim 6, wherein each of the pressure chambers has an elongated shape, and the predetermined direction is a transverse direction of the pressure chamber.

9. The liquid-droplet jetting apparatus according to claim 6, wherein the plate has an electroconductive substrate which is plate-shaped and is arranged on the one surface of the channel unit, and an insulating layer formed on a surface of the electroconductive substrate on a side opposite to the pressure chambers.

10. The liquid-droplet jetting apparatus according to claim 6, wherein the plate is formed of an insulating material.

11. The liquid-droplet jetting apparatus according to claim 6, wherein the length in the predetermined direction of the portion, of the piezoelectric layer, which faces one of the pressure chambers is in a range of 1/12 to 1/3 of the length of the one of the pressure chambers in the predetermined direction.

12. The liquid-droplet jetting apparatus according to claim 11, wherein the length in the predetermined direction of the portion, of the piezoelectric layer, which faces the one of the pressure chambers is 1/4 of the length of the one of the pressure chambers in the predetermined direction.

13. The liquid-droplet jetting apparatus according to claim 6, wherein:

a thinned portion is formed in a portion of the plate facing one of the pressure chambers, the thinned portion having a thickness smaller than a thickness of other portion of the plate; and the thinned portion has an area not overlapping with the piezoelectric layer.

14. The liquid-droplet jetting apparatus according to claim 13, wherein the thinned portion is extended in the predetermined direction from the other edge in the predetermined direction of the one of the pressure chambers, and does not overlap with the piezoelectric layer.

15. The liquid-droplet jetting apparatus according to claim 14, wherein a length of the thinned portion in the predetermined direction is greater than the length of the piezoelectric layer in the predetermined direction.

16. The liquid-droplet jetting apparatus according to claim 15, wherein the length of the thinned portion in the predetermined direction is not less than half the length of the one of the pressure chambers in the predetermined direction.

17. A liquid transporting apparatus which transports a liquid, the apparatus comprising:

a channel unit which includes a pressure chamber; and a piezoelectric actuator which changes a volume of the pressure chamber to apply a pressure to a liquid in the pressure chamber, and which includes a plate arranged on one surface of the channel unit so as to cover the pressure chamber; a piezoelectric layer arranged at an area, of the plate, facing the pressure chamber such that the piezoelectric layer covers one edge of the pressure chamber in a predetermined direction and that the piezoelectric layer is extended in the predetermined direction from a position overlapping with the one edge of the pressure chamber, the area being on a surface of the plate on a side opposite to the pressure chamber; an individual electrode arranged on one surface of the piezoelectric layer; and a common electrode arranged on the other surface of the piezoelectric layer;

wherein a length of a portion in the predetermined direction, of the piezoelectric layer, which faces the pressure chamber is smaller than half a length of the pressure chamber in the predetermined direction.

18. A liquid transporting apparatus which transports a liquid, the apparatus comprising:

a channel unit which includes a plurality of pressure chambers; and a piezoelectric actuator which changes a volume of at least one of the pressure chambers to apply a pressure to a liquid in the at least one of the pressure chambers, and which includes a plate arranged on one surface of the channel unit so as to cover the pressure chambers and having a surface with insulating property, the surface being on a side opposite to the pressure chambers; a piezoelectric layer arranged at areas, of the plate, facing the pressure chambers such that the piezoelectric layer covers one edge of one of the pressure chambers in a predetermined direction and that the piezoelectric layer is extended in the predetermined direction from a position overlapping with the one edge of the one of the pressure chambers, the areas being on a surface of the plate on a side opposite to the pressure chambers; individual electrodes arranged on one surface of the piezoelectric layer corresponding to the areas; and a common electrode arranged on the other surface of the piezoelectric layer;

wherein the plurality of pressure chambers includes a first pressure chamber and a second pressure chamber, a length of a portion in the predetermined direction, of the piezoelectric layer, which faces the first pressure chamber is smaller than half a length of the first pressure chamber in the predetermined direction; and a wiring connected to an individual electrode for the second pressure chamber of the individual electrodes is formed in an area, of the plate, which overlaps with the first pressure chamber and in which the piezoelectric layer is absent, the area being on the surface of the plate on the side opposite to the first pressure chamber.

* * * * *